US005542272A

United States Patent [19]

Heinemann

[11] Patent Number: 5,542,272

[45] Date of Patent: Aug. 6, 1996

[54] NUMERICAL COMBINATION LOCK WITH TURNING KNOB, CAM PLATE, AND DROP LEVER

[75] Inventor: Albert Heinemann, Ehrenkirchen, Germany

[73] Assignee: Theodor Kromer GmbH & Co. KG Spezialfabrik Fur Sicherheitsschlosser, Umkirch, Germany

[21] Appl. No.: 271,929

[22] Filed: Jul. 7, 1994

[30] Foreign Application Priority Data

Jul. 14, 1993 [DE] Germany ..... 43 23 493.3

[51] Int. Cl.[6] ..... E05B 49/00; E05B 37/08

[52] U.S. Cl. ..... 70/278; 70/133; 70/277; 70/322; 70/303 A

[58] Field of Search ..... 70/277, 278, 303 A, 70/301, 302, 303 R, 133, 321, 322

[56] References Cited

U.S. PATENT DOCUMENTS

| | | | |
|---|---|---|---|
| 3,045,466 | 7/1962 | Herlong | 70/133 |
| 4,745,784 | 5/1988 | Gartner | 70/277 |
| 4,756,176 | 7/1988 | Uyeda | 70/315 |
| 4,831,851 | 5/1989 | Larson | 70/277 |
| 4,967,577 | 11/1990 | Gartner et al. | 70/303 A |

FOREIGN PATENT DOCUMENTS

| | | | |
|---|---|---|---|
| 453003 | 11/1948 | Canada | 70/322 |
| 2816969 | 10/1979 | Germany . | |
| 3029735 | 3/1982 | Germany . | |
| WO8912154 | 12/1989 | WIPO . | |
| WO9211430 | 7/1992 | WIPO . | |

*Primary Examiner*—Darnell M. Boucher
*Attorney, Agent, or Firm*—Panitch Schwarze Jacobs & Nadel, P.C.

[57] ABSTRACT

A numerical combination lock 1 has a turning knob 3, by means of which a cam plate 4 can be turned in order to operate a drop lever 5 that is hinged to a locking bolt 2 of the lock 1 and in this way to draw the locking bolt back to the open position. This can be done only by means of the correct selection of an opening combination which, also with the aid of the turning knob 3, has to be set through repeated turning. Following each setting, the turning knob 3 can be displaced in an axial direction in order to operate a switch 11 on a printed circuit board 35 each time in accordance with that particular setting value. In this way, an electric motor 12 is controlled that moves a coupling member 14 on a sliding bar 13 into the area of a first working surface 15 of the cam plate 4, if the correct opening combination has been entered. The sliding bar 13 has a fixed projection 20 that faces the cam plate 4, and the cam plate 4 has a second working surface 21, which comes into a working relationship with the projection 20 during the turning back of the cam plate 4 to close the locking bolt 2. The sliding bar 13 is thus forced back to its original position as a result of the turning of the cam plate 4 during the closing of the lock 1, even in the event that a resetting spring 22, which may be provided, malfunctions. As a result, after being closed, the lock 1 is always ready for its next opening procedure, even if a resetting spring 22 were to fail to move the sliding bar 13.

13 Claims, 3 Drawing Sheets

Fig. 2
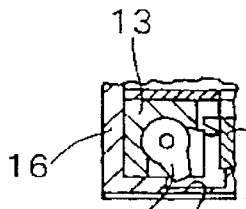
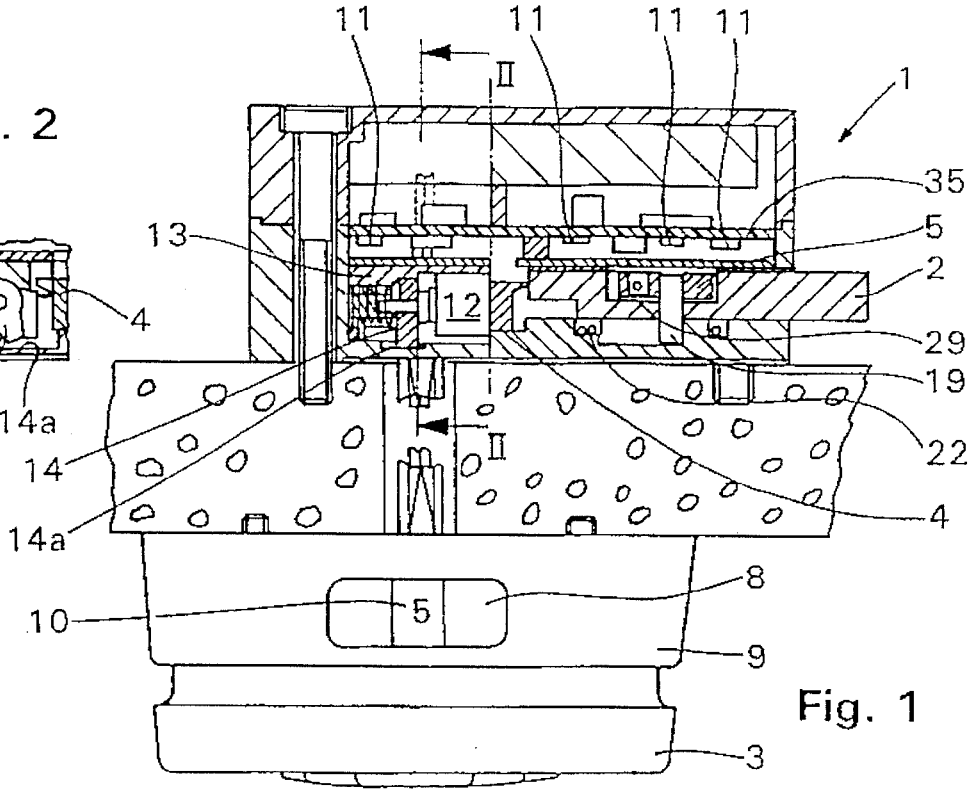
Fig. 1
Fig. 4
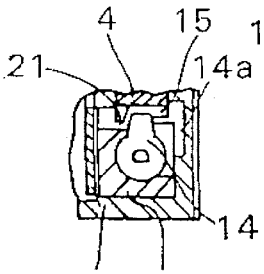
Fig. 3
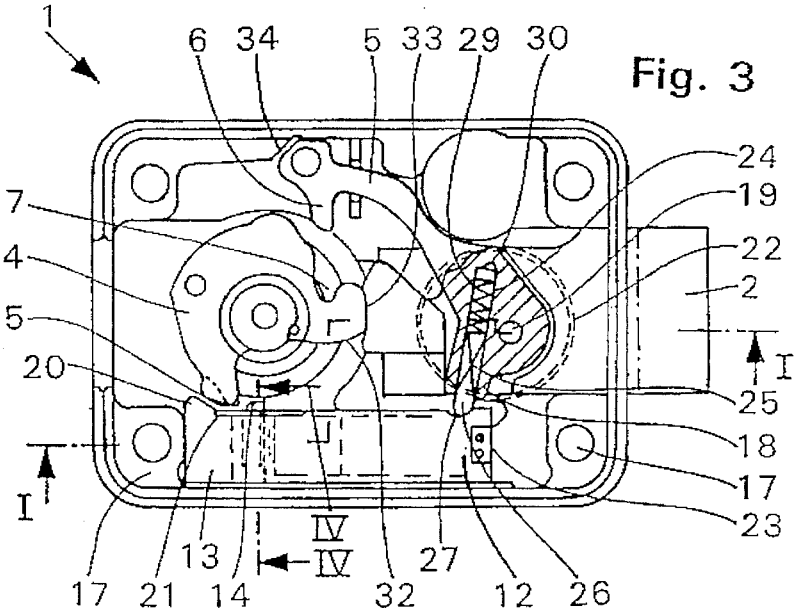

NUMERICAL COMBINATION LOCK WITH TURNING KNOB, CAM PLATE, AND DROP LEVER

FIELD OF THE INVENTION

The invention relates to a numerical combination lock with a turning knob, a cam plate, and a drop lever that is hinged to a locking bolt. With the correct selection of the lock's opening combination the drop lever engages, in particular by means of a hook-like projection, with a drop opening of the cam plate, so that a turning of the cam plate pulls the locking bolt open by means of the drop lever. The turning knob is also adapted for setting of the individual values of the opening combination at different angles of rotation, and at each setting of a value can, in addition to its ability to rotate, also be displaced axially in order to operate an electric switch that is assigned to the value in question, so that the individual setting values can be sent electrically, by means of the switches that are assigned to them, to a memory that contains the relevant opening combination and that controls an electric motor. The electric motor is arranged in the interior of a sliding bar in such a way that, when the opening combination is correctly selected, a coupling member carried by the sliding bar is moved by the motor into the region of a first working surface of one cam of the cam plate, so that the turning of the cam plate operates this sliding bar, which, for its part, acts upon a lever arm of the drop lever and swivels this drop lever into the engaging position. The position of the first working surface and the drop opening are matched to each other in such a way that the displacement of the sliding bar and the swiveling of the drop lever are completed at approximately the same time.

BACKGROUND OF THE INVENTION

Numerical combination locks are known, for example from DE 28 16 969 A1 or from DE 30 29 735 C2, in which the opening combination can be set mechanically by means of several tumbler plates, whereby by turning of the turning knob, all of the tumbler plates eventually become arranged in such a way that a finger located on the drop lever finally matches recesses in the tumbler plates in such a way that the drop lever is no longer held up, but instead, when the finger enters these recesses, the drop lever can also enter the drop opening in the cam plate. In this case, there exists the danger that, due to user error, the user will have to select the opening combination several times in order finally to be able to open the lock.

For that reason, there is known from U.S. Pat. No. 4,745,784 a tumbler lock in which the opening combination is contained in an electronic memory, and the turning knob is used to operate the actual values of the opening combination in the correct sequence by means of individual switches so that the comparison can take place between the setting selected by the turning knob and the stored value. If the values agree, the drop lever is brought into the coupling position of the cam plate by means of electrical operation, whereby, in the case of this previously known solution, the drop lever is held against a lateral finger with the aid of an additional plate, which, after the correct opening combination is selected, is turned in such a way that the drop lever can drop into the drop opening of the cam plate.

In addition, it is known from WO 92/11430 that a sliding bar can be provided to force the drop lever to swivel into the drop opening of the cam plate. This sliding bar is displaced by a turning of the turning knob and at the same time acts upon a lever arm, which, for its part, is joined with the drop lever and then swivels this drop lever. In conjunction with this, this sliding bar is to be pushed against a resetting spring, which pushes the sliding bar back into its original position after the operation of the drop lever, so that the sliding bar is again available for operating the drop lever the next time the opening procedure is carried out.

If, however, the resetting spring of the sliding bar malfunctions or even breaks, or if, for example after a certain amount of wear, the sliding bar becomes jammed in the position it is in at the instant of the coupling of the drop lever, it will not be returned to its original position.

In spite of that, however, the user can still close the lock again by means of a reverse direction turning movement of the turning knob, whereby this locking takes place independently of the sliding bar that was mentioned. If the lock is now to be opened once again, it is no longer possible because the sliding bar is not in its original position, from which it is able to move the drop lever into the drop opening.

SUMMARY OF THE INVENTION

The invention therefore accomplishes the object of creating a combination lock of the type mentioned in the Field of the Invention, in which an unnoticed remaining of the sliding bar in its open position, which is opposite to its original position, is prevented.

In order to achieve this object, the tumbler lock defined at the beginning is characterized by a sliding bar having a fixed projection which faces the cam side and which, when the cam plate is turned back to close the locking bolt, is contacted by a second working surface of the cam plate, so that the sliding bar is forced to move back to its original position by means of the turning of the cam plate when the lock is closed.

Since the cam plate only has to carry out fractions of a turn for the opening and closing movement, it can be provided with an appropriate second working surface, which contacts the projection of the sliding bar when the cam plate is turned in the direction that is opposite to that which is used to open the lock. That is, when the lock is closed, the sliding bar is forced to move back into its original position, because the second working surface of the cam plate now contacts the projection of the sliding bar in such a way that the sliding bar is moved back once again. Even if it were to stick a little, the forced displacement would bring about the resetting of this sliding bar in any case, so that it would again be available for the next opening procedure.

At the same time, in order to achieve a compact design even in a small lock housing, it is helpful if the first working surface and the second working acting surface are placed somewhat coaxially one behind the other on the cam plate. This serves to make it possible that when the cam plate is turned to open the lock, the coupling member and the first working surface cooperate with each other. The sliding bar is thus displaced at the correct time in such a way that the drop lever with its hook-like projection can be swiveled into the drop opening, so that a further turning of the turning knob, by which the first working surface is now swiveled out of the area of the coupling member, can pull the locking bolt back. If the cam plate is turned in the opposite direction, after a certain turning travel the second working surface of the cam plate comes up against the projection and can now, during the final turning of the cam plate to close the locking bolt, also move the sliding bar into its original position, which in turn allows the forced swiveling of the drop lever during the next opening procedure.

It can be helpful if the sliding bar is displacable against the pressure of a resetting spring during the swiveling of the drop lever into the cam plate. This does indeed somewhat increase the force that has to be used by the user in order to open the locking bolt. However, this makes it possible for the sliding bar to be moved back into its original position following the opening procedure, even while the lock is still open, if this resetting spring is strong enough. For the resetting of the locking bolt back into the locked position, the user then does not also have to apply the force necessary to move the sliding bar back to its original position. In every case, the closing of the lock will be easier if such a resetting spring is present.

Nevertheless, the return of the sliding bar to its original position is ensured, even if this spring malfunctions. In this connection, the force of the resetting spring for the sliding bar can be selected to be of such a magnitude that it at least assists the displacement of the sliding bar back to its original position. If this resetting force is not sufficient for an automatic resetting, the resetting of the sliding bar is nevertheless assisted, as long as the resetting spring is functioning, and the locking movement of the lock is thus made easier. If the force is sufficient for an automatic resetting, the user does not have to move the sliding bar back when closing the lock, as long as the spring is functioning.

In order that the forced swiveling of the drop lever, with the aid of the sliding bar that can move in a straight line, can be carried out past a dead center position without secondary bending, the lever arm provided on the drop lever and which helps it to swivel into its coupling position can have a pin that projects from it and is displacable against a pressure spring. The pin engages with its free, projecting end a recess in the sliding bar and, at least in the open position of the drop lever, runs diagonally in the sense that with its end engaging the sliding bar, it points somewhat against the direction of displacement effected during opening. During displacement of the sliding bar, this pin can be adjustable in the lever arm against the pressure spring in order to compensate for the difference in travel between the arcs described by the lever arm and the pin, and the contrasting straight movement of the sliding bar.

Even though the sliding bar is thus displaced with the aid of the cam plate in a straight line against a coupling member that is moved into its operational position by means of a motor, there results from this displacement a swiveling of the lever arm, and the drop lever with it, since the shortening of the lever arm during the displacement of the sliding bar is taken up by the adjustability of the pin. If necessary, however, a coupling between the sliding bar and the lever arm would also be possible by means of a sliding block.

Basically, it is sufficient if the recess that receives the free end of the pin overlaps the pin only on the side that contacts the pin during the displacement of the sliding bar for the opening procedure. The recess could then freely run out to the end of the sliding bar, since the drop lever is raised up again by the pressure spring of the pin during the corresponding reverse turning. If, however, an impact load on the lock takes place, the pin could slip from the end of the sliding bar through corresponding movements of the drop lever and its spring mounting, and so make its way into a coupling position in which the locking bolt can again be drawn into the open position by a turning of the turning knob, without the opening combination having to be selected.

A further development of the invention of very particular importance can therefore comprise the fact that the recess in the sliding bar that receives the free end of the pin is restricted on both sides of the sliding bar. Since the pin on the lever arm of the drop lever is thus overlapped on both sides of its free end that can be swiveled by the displacement of the sliding bar, it cannot slip from the sliding bar even in the event of an impact load or the like, and in that event, thus holds the drop lever outside the region of the drop opening for a period of time until the forced swiveling of the drop lever into the coupling position takes place through a displacement of the sliding bar, following the appropriate relevant selection of the opening combination.

In order that the pressure spring for the pin can carry out its function even when in a broken state and hold up the drop lever as well as lift it out into the appropriate blocking position during the closing of the lock, an opening to accept the pin and the pressure spring for the pin can be provided in the drop lever, which opening has, at least in some regions, a polygonal cross-section, tetragonal for example, and in particular square. One or both ends of the pressure spring can run parallel to a wall of the opening up to the corner where it meets the adjacent wall, and/or at least the end windings of the pressure spring can be configured in a polygonal or tetragonal fashion, so that the opening encloses the ends of the pressure spring or the polygonal windings in a form-fitting manner. As a result, the pressure spring cannot turn, even under pressure, and even if it is broken, the broken locations continue to support each other because the broken pieces cannot be turned inside of each other under compression loading. In this way, the full function of the drop lever and its movement is retained, even if there is a break in this spring.

In this connection, it is especially beneficial if the windings of the pressure spring are wound in a tetragonal fashion over their entire lengths. The spring thus has no possibility at all of carrying out additional relative movements in the direction of rotation when it is acted upon, so that in every case, even when it is in a broken state, it exerts its springing action and then behaves to a certain extent as if two springs of that type were placed one after the other in the opening.

In addition, the pin that is on the inside of the drop lever and that lies against the pressure spring can have a continuation that fits the inside of the pressure spring and that is shorter than the spring by at least the length of the spring travel when compressed. As a result, the pressure spring is guided over a great part of its length both on the inside and on the outside, especially when it is under compression loading, so that not only is the danger of a break in the spring reduced, but even in the event there is such a break, the spring pieces cannot be pressed inside one another, which would lead to complete or partial loss of the spring action.

The features and measures described above permit an additional advantageous further development, to the effect that the pin can have a tetragonal, and in particular square cross-section, as a result of which, it correspondingly matches the tetragonal or square cross-sectional form of the opening that receives it. Its end that works in conjunction with the sliding bar is rounded off, whereby the middle or the axis of curvature of this rounding off runs approximately parallel to the swiveling axis of the drop lever, and the rounded-off area of the pin lies with line contact against the areas of the recess in the sliding bar that overlap it in the sliding direction. In comparison with a spherical rounding off of the end of the pin, this provides a better positioning and thus a more secure operation during the swiveling of the drop lever by means of the swiveling of the pin. Nevertheless, during its swiveling, the end of the pin can carry out a rolling contact movement with respect to the sliding bar, which is to be moved in a straight line.

For operation of the lock with little effort, and in particular, when closing the lock or displacing the locking bolt, it is helpful if the cam plate has at its circumference in the region adjacent to the drop opening a sliding curve, and the locking bolt exhibits a projecting thrust surface. In this way, it is possible to ensure that during the reverse turning of the cam plate when the lock is being closed, the locking bolt does not have to be moved into the closed position by means of the drop lever, or exclusively by means of the drop lever. Instead, the locking bolt is moved with little effort directly at the projecting thrust surface so that the drop lever remains to a great extent not placed under a load by the cam plate, and can thus be lifted in a problem-free manner from the area of the drop opening by the pressure spring of the lever arm, and swiveled into its blocking position at a corresponding blocking projection of the lock case.

At the same time, this projecting thrust surface has the advantage that in the closed position, if the locking bolt were to be placed under a compression load in the opening direction, it can then support itself directly against the cam plate by means of its projecting thrust surface, so that the drop lever is not pressed and wedged with respect to its blocking projection or blocking point, and cannot impede an opening of the lock. Thus, even if a pressure is acting upon the locking bolt, the sliding bar can be moved to open the lock, and the drop lever can thus be swiveled into the drop opening of the cam plate. Following that, the locking bolt can be drawn back by a further turning of the turning knob.

Primarily by means of a combination of one or more of the features and measures described above, there results a lock of the type mentioned at the beginning, in which the security against a malfunctioning of individual parts is improved. In particular, a resetting of the sliding bar into its original position, which is critical for the opening of the lock, is ensured by virtue of the fact that in all cases, whether a resetting spring is provided for this sliding bar or not, this is forced to take place. It is also possible to take precautions to ensure that the lever arm, which engages with the sliding bar by means of a pin with a spring, does not slip from the sliding bar as a result of blows or shaking, thus eliminating the necessity of selecting the opening combination in order to be able to open the lock. In addition, the drop lever, and its resetting into a position in which it is swiveled out of the region of the cam plate, functions even when the lever arm spring breaks. The mechanical components of the lock are thus configured in such a way that the functional security of this lock, and even its security against unauthorized use, is increased.

BRIEF DESCRIPTION OF THE DRAWINGS

The foregoing summary, as well as the following detailed description of preferred embodiments of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities shown. In the drawings, represented in partially schematic form:

FIG. 1 is a horizontal section view of a numerical combination lock taken along line I—I in FIG. 3, partly through the locking bolt and the hinge bearing provided on it for the drop lever, plus a part of the cam plate on one side and the sliding bar displaced above it and the fastening of the lock case on the other, as well as through a door or the like that is secured by the lock, with the breech for the shaft or the axle of the turning knob, which is shown in a top view and makes possible both a turning movement as well as an axial displacement movement;

FIG. 2 is a partial section view taken along line II—II in FIG. 1 through the portion of the sliding bar at which there is arranged a coupling projection that can be adjusted by means of a motor and that can be adjusted from the inactive position shown in FIG. 2 into the coupling position that can be seen in FIG. 4 if the opening combination is correctly selected;

FIG. 3 is a partial vertical section view of the inside of the numerical combination lock, with a view of the locking bolt, the drop lever, the cam plate, and the sliding bar for operation of the drop lever;

FIG. 4 is a partial cross-section view taken along the line IV—IV in FIG. 3, analogous to the representation in FIG. 2, wherein the coupling projection has been swiveled or turned into its coupling position;

DETAILED DESCRIPTION OF PREFERRED EMBODIMENT

Figure 5:
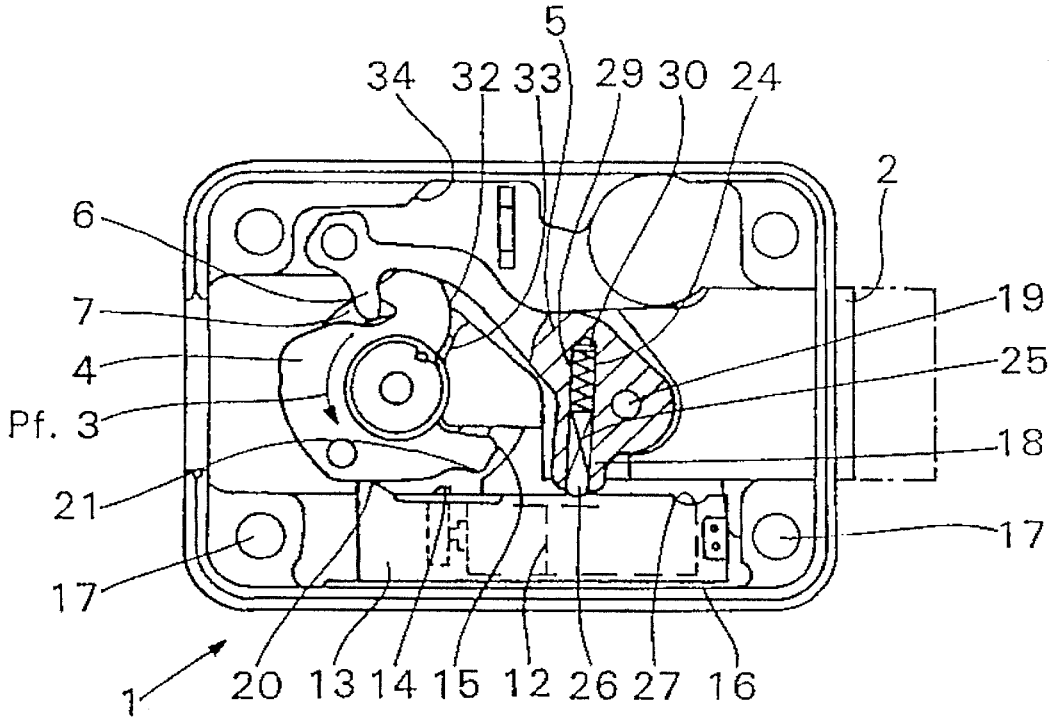
FIG. 5 shows a representation of the lock corresponding to FIG. 3, wherein the sliding bar has been displaced towards the right from its original position, and has thereby swiveled the drop lever by means of a lever arm in such a way that the drop lever is working in conjunction with the cam plate so that as a result of their turning the locking bolt is drawn back.
Figure 6:
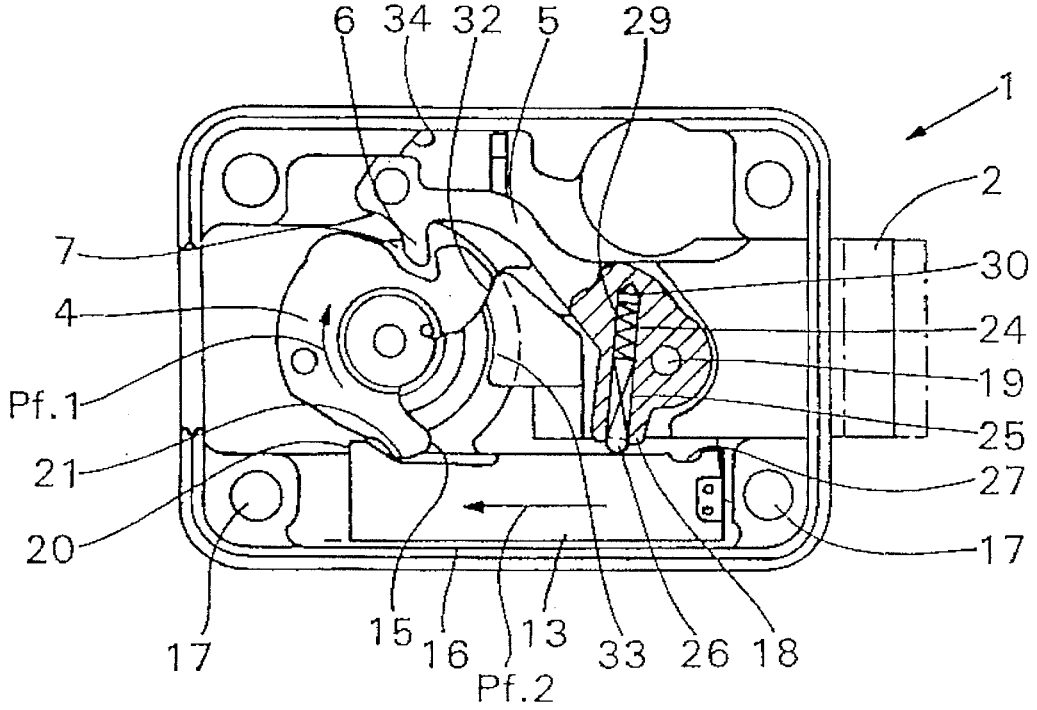
FIG. 6 shows an intermediate position between the closed position of the lock shown in FIG. 3 and the open position of the lock shown in FIG. 5, wherein the locking bolt is moved back from the open position and into the closed position, and the sliding bar is simultaneously forced to move back into its original position.

A numerical combination lock that is designated in its entirety by 1, also referred to hereinafter as "lock 1," has, for its operation for the selection of an opening combination and the displacing of a locking bolt 2, a turning knob 3 and a cam plate 4. Hinged to the locking bolt 2 there is a drop lever 5, which, when the opening combination is correctly selected, can be moved into and engages with a drop opening 7 of the cam plate by means of a hook-like projection 6, as can be seen in FIGS. 5 and 6. With such an arrangement, a turning of the cam plate 4 has the effect that the locking bolt 2, by means of the drop lever 5 that is hinged to it, is drawn back from the position shown in FIG. 3 and into the position shown in FIG. 5, which means that the lock 1 has been opened.

In conjunction with this, the turning knob 3 is used in the usual way for setting and selecting individual values of an opening combination, whereby in an observation window 8 in the housing 9 adjacent to the turning knob 3, each of these values 10 can be seen, one after the other. By way of example, in FIG. 1 the value "5" is just being selected. Through the setting of the turning knob 3 at different angles of rotation a variety of such values can be set or selected one after the other.

In this connection, at each setting of such a value the turning knob 3 can, in addition to its ability to rotate, also be displaced axially in order to actuate a switch 11 that is assigned to the value in question. In this way the individual setting values can be sent electrically to a memory, for example a microprocessor, by means of the switches 11 on printed circuit board 35 that are assigned to these values. Thus, a value is set each time by turning the turning knob, and stored by pressing down the turning knob 3. The memory contains the relevant opening combination of the lock 1 and controls an electric motor 12 in the interior of sliding bar 13, Which is still to be explained, in such a way that when the correct combination is selected (dialed), a coupling member 14 in sliding bar 13 is moved into the region of a first working surface 15 of the cam plate 4, this first working surface 15 being an additional cam of cam plate 4, so that the turning of cam plate 4 operates sliding bar 13. In this regard, in the preferred embodiment the first working surface 15 is located on a side of cam plate 4 that faces away from or lies opposite to its drop opening 7.

The sliding bar 13 can be seen in each of the FIGS. 3, 5 and 6 underneath the cam plate 4, approximately at the lower wall 16 of the lock housing, where a distance is provided between the fastening locations 17 that is longer than the length of sliding bar 13. Sliding bar 13, from the original position shown in FIG. 3, which is the furthest left position and in which position it strikes against the fastening location 17, can thus be displaced towards the right as can be seen in FIGS. 5 and 6.

On one side the sliding bar 13 engages with a lever arm 18 of the drop lever 5, which lever arm 18 is directed somewhat downward with respect to the hinge bearing 19 of the drop lever 5, and on the other side lies opposite that part of the drop lever 5 that has the hook-like projection 6. Thus, if the lever arm 18 is swiveled to the right, in a counter-clockwise direction, this also entails a sinking of the projection 6 from the position shown in FIG. 3 and into the coupling position shown in FIGS. 5 and 6.

Hence, when the sliding bar 13 is operated and is displaced towards the right from its original position shown in FIG. 3, the lever arm 18 is swiveled in the corresponding direction, as a result of which the drop lever 5 moves into the engaging position. In this connection, the first acting surface 15 of the cam plate 4 and its drop opening 7 are matched to each other in such a way that the displacement of the sliding bar 13 and the swiveling of the drop lever 5 in particular are completed at approximately the same time. This can be seen in FIG. 5, where the position is just being reached in which the first acting surface 15 of the cam plate 4 has been swiveled out of the region of the coupling member 14 of sliding bar 13, and the locking bolt has been drawn back into the open position. In this position, further turning of the cam plate 4 is no longer possible and no longer necessary, since the locking bolt 2 is unlocked.

It should be mentioned at this point that in its inactive position the coupling member 14, that can be turned, by the electric motor 12, can engage with a recess **14*a* in a housing wall, so that coupling member 14 can thus have a length that is sufficiently larger but a compact arrangement of the sliding bar 13 is nevertheless possible. In addition, the recess 14*a* shown in FIG. 1 can be dimensioned such that in this inactive position, the coupling member 14 also locks the sliding bar 13, because the recess 14*a* is so short in the direction of displacement that in this position the coupling member 14 is overlapped by the end of the recess 14*a* like a limit stop. If the sliding bar 13 is displaced back to its original position shown in FIG. 3, in a manner that is still to be described, coupling member 14 can also be turned back to this inactive blocking position with the aid of the motor 12**.

In FIGS. 3, 5 and 6, it can be seen that the sliding bar 13 has on its upper side that faces the cam plate 4 a fixed projection 20 that faces the cam plate. Indicated primarily in FIGS. 3 and 4 is the fact that the cam plate 4 has a second working surface 21 which, during a turning back of the cam plate 4, as indicated by the arrow Pf1 in FIG. 6, operates in cooperation with projection 20 of sliding bar 13 to close locking bolt 2. By the turning of the cam plate 4 during the closing of the lock 1, sliding bar 13 is thus forced back to its original position shown in FIG. 3, this displacement of the sliding bar 13 being indicated in FIG. 6 by the arrow Pf2.

The first working surface 15 and the second working surface 21 are arranged on the cam plate 4 approximately coaxial to one another in accordance with FIGS. 3 and 4. Each of the first and second working surfaces (15 and 21) has a different contour and is located between the rotatable coupling member 14 and the projection 20 of the sliding bar 13. The turning of the cam plate 4 in one direction shown by the arrow Pf3 in FIG. 5 then brings about a cooperation of the coupling member 14 with the first acting surface 15 in the sense of a displacement of the sliding bar 13 towards the right from its original position, and with that, a swiveling of the drop lever 5 into the engaged position against the cam plate 4. On the other hand, as a result of turning the cam plate 4 in the opposite direction, as shown by arrow Pf1 in FIG. 6, the second working surface 21 strikes projection 20 of sliding bar 13, and thus pushes the sliding bar 13 back in the direction of arrow Pf2.

Thus, when the lock 1 is being closed, the sliding bar 13 is forced back to the original position shown in FIG. 3, which is absolutely necessary in order to be able to again bring the drop lever 5 into a working relationship with the cam plate 4 during the next opening procedure, so that the lock 1 can be opened once again. If sliding bar 13 were to be pushed back from the open position shown in FIG. 6 to its original position solely by means of a spring, and if such a spring were to break, the lock 1 could indeed be closed, but could then no longer be opened.

In the embodiment shown in FIG. 1 and 3 provision is made such that sliding bar 13 can be moved against the pressure of a resetting spring 22 during the swiveling of the drop lever 5 into the cam plate 4. This resetting spring 22 is known as a volute spring, which is arranged approximately around the hinge bearing 19 of the drop lever 5 and with a spring leg 23 engages the face (lying at the front in the direction of displacement of sliding bar 13 during opening) of sliding bar 13. In this regard, the pressure of resetting spring 22 for sliding bar 13 is sufficiently great that it can effect the moving of the sliding bar 13 back to its original position with or without assistance.

The latter has the advantage that with a functioning spring 22, the sliding bar 13 will already be pushed back to the original position shown in FIG. 3 when the lock is still open as shown in FIG. 5, and coupling member 14 and the first working surface 15, as clearly seen in FIG. 5, are no longer in engagement with one another because the cam plate 4 has been turned sufficiently, or possibly the coupling member 14 in sliding bar 13 has been turned back to its inactive position.

As a result of that, or even in the case of a weaker resetting spring 22, a closing of the lock with little effort results, because the sliding bar 13 does not necessarily have to be pushed back to its original position by the user, but rather this resetting of the sliding bar 13 is carried by, or is at least assisted by, the spring 22. If this spring 22 malfunctions, however, as a result of the configuration in accordance with the invention, the sliding bar 13 can still be moved back to its original position by means of its projection 20, which allows for a later reopening of the lock 1.

Sliding bar 13 carries out an essentially straightline, guided, back-and-forth movement, while the lever arm 18 makes a swiveling movement around its hinge bearing 19, thus moving through an arc. Provision has therefore been made that the coupling arm 18, provided on the drop lever 5 to serve for swiveling the lever into the coupling position, has a pin 25 that can be displaced against a pressure spring 24 in the direction of its longitudinal extension and that protrudes somewhat from the lever arm 18. Pin 25 with its free protruding end 26 engages a recess 27 on the upper side of sliding bar 13, and to a certain extent, thus has a kind of gearing with sliding bar 13. In this connection, at least in the open position of the drop lever 5, the lever arm 18 with its pin 25 runs diagonally in the sense that with its end 26 that engages sliding bar 13, it points somewhat against the direction of displacement effected during opening. That is, pin 25 forms with the direction of movement and the extension of the sliding bar 13 an acute angle, which can be clearly seen in FIG. 3. If the sliding bar is displaced, a corresponding swiveling of the pin 25 is produced, and thus of the lever arm 18 as well, into a position in which the above-mentioned angle becomes larger and, for example, can become nearly a right angle, as shown in FIGS. 5 and 6.

In order to compensate for the difference in travel between the arcs described by lever arm 18 and pin 25, and the contrasting straight movement of sliding bar 13, pin 25 is adjustable in the lever arm 18 against a pressure spring 24. During the swiveling, lever arm 18 can thus be shortened by means of a deeper pressing of pin 25 into lever arm 18. In other words, the lever arm 18 adapts itself in length.

In conjunction with this, recess 27 that receives free end 26 of pin 25 in sliding bar 13 is restricted on both sides of the pin 25. That is, in the direction of displacement as well as in the direction opposite to the displacement a positive fit is provided between the end 26 of pin 25 and sliding bar 13. The end 26 of pin 25 does indeed come out of recess 27 during displacement of the sliding bar to the right, which is easily possible as a result of the diagonal and rounded off configuration, but the pin 25 is fixed in a positive-fit manner in the original position of the sliding bar 13 shown in FIG. 3, so that an impact on the lock 1 that could bring about a brief swiveling of the drop lever 5 is prevented, and the pin 25 cannot slip from sliding bar 13. The pin 25, which stands diagonally in the uncoupled position of the drop lever 5, is thus overlapped and retained in a positive-fit manner at its end 26 on the side facing away from the direction of movement, as can be clearly seen in FIG. 3.

The pressure spring 24 for the pin 25 is thus important for the mechanical functioning of the lock. In order that it can fulfill its purpose, even if it were to break for some reason, this pressure spring 24 for pin 25, which is placed in a corresponding opening 29 in drop lever 5, which opening 29 also receives pin 25, is provided, at least in some regions, with a polygonal cross-section, tetragonal for example, and in particular square, whereby at least the windings that form the end of this pressure spring 24 are configured in a polygonal or tetragonal manner. It is even more favorable if the windings of the pressure spring 24 are wound in a corresponding polygonal or tetragonal manner over the entire length of the spring, and are thus extensively matched in a form-fitting manner to the inner cross-section of the opening 29, so that a turning of the spring or of broken pieces of the spring is prevented and the spring cannot slip laterally. If it should break, its ends thus cannot be pushed inside of one another, so that the spring 24 retains its function as if two springs were supported on each other.

In conjunction with this, the pin 25 that lies against the pressure spring 24 in the inside of the drop lever 5 and the lever arm 18 can have a continuation 30 that fits inside the pressure spring 24 and that is shorter than the pressure spring 24 by at least the length of the spring travel when compressed, but that also supports and guides the pressure spring 24 from the inside.

The pin 25 can also have a tetragonal, and in particular square, cross-section corresponding to the cross-sectional contour of the opening 29, and thus can be arranged in the opening 29 in a somewhat form-fitting manner, so that it is movable only in the direction of its longitudinal extension. Its end 26 that works in conjunction with the sliding bar 13 can, however, be rounded off in such a way that the middle or axis of curvature of this rounding off, as can be seen in FIGS. 3, 5 and 6, runs approximately parallel to the swiveling axis 19 of the drop lever. As a result, during a relative movement with respect to sliding bar 13, end 26 can effect a rolling contact movement on the sliding bar. However, the rounded-off area of the pin 25 makes contact with the areas that touch it and with recess 27 of sliding bar 13 as line contact.

If the closed lock 1 shown in FIG. 3 is to be opened, the user has to dial the individual values 10 one after the other by means of turning knob 3, and press turning knob 3 down axially after each setting. As an example, an opening combination can include seven values. As a result, motor 12 is set into operation to swivel the coupling member 14 from the inactive position shown in FIG. 2 to the coupling position shown in FIG. 4, so that the first working surface 15 of cam plate 4 can now work together with it. By means of a further turning of the turning knob 3, cam plate 4 is turned, and as a result, sliding bar 13 is thus moved towards the right from the position shown in FIG. 3, which brings about the previously mentioned swiveling of the drop lever 5 into the coupling position. Further turning then draws the locking bolt 2 into the open position shown in FIG. 5.

In order to close the lock 1 again, that is to again move the locking bolt 2 shown in FIG. 6 from the position in FIG. 5 and to that of FIG. 3, the turning knob 3, and with it the cam plate 4, is turned in the opposite direction as shown by the arrow Pf1 in FIG. 6.

If sliding bar 13 has already been pushed back by the force of resetting spring 22, then only the locking bolt 2 has to be moved into its closed position by the turning of turning knob 3. Otherwise, as a result of this turning of the cam plate 4 in the direction of the arrow Pf1, projection 20 of sliding bar 13 is struck by the counter projection (second working surface) 21 of the cam plate, and sliding bar 13 is pushed back in the direction of the arrow Pf2.

In the present embodiment, the cam plate 4 has at its circumference adjacent to the drop opening 7 a displacement curve 32, and the locking bolt has a projecting thrust surface 33 upon which this displacement curve 32 acts during the closing movement shown in FIG. 6. In this way, the turning movement of the cam plate 4 is not transmitted via the drop lever 5, which would also be possible, but is instead transmitted directly to the locking bolt 2. In the closed position, the area adjacent to the projecting thrust surface 33 produces a support for the closed locking bolt against the cam of the cam plate 4, which borders the drop opening 7 for cooperation with the hook-like projection 6 of the drop lever 5. This can be seen clearly in FIG. 3. If a compression force arises on the locking bolt 2, when it is in the closed position, this force is thus not transmitted via the drop lever to its blocking stop 34 in the lock case or lock housing. Thus, the drop lever 5 does not stick. In spite of pressure on the locking bolt 2, the drop lever 5 can thus be swiveled into its coupling position with the aid of the sliding bar 13 during the corresponding closing operation of the lock.

Since the sliding bar 13 is forced to be pushed back to its original position with the help of the cam plate 4, there is no need to fear that it will remain in its displaced position after being operated, which would still make it possible to close the lock 1 without the user noticing the faulty positioning of the sliding bar 13. If the resetting spring 22 provided in the preferred embodiment is still present and operative, the lock can be closed with little effort, so that the user could notice the malfunctioning of this spring 22 as manifested by a difficult operation.

Figure 7:
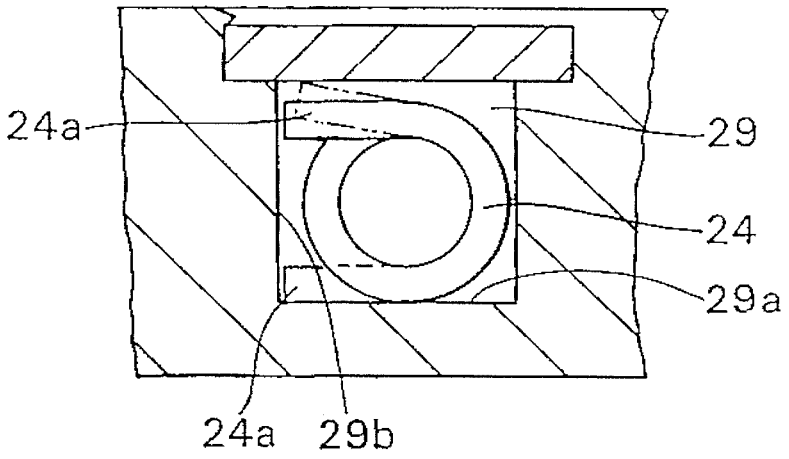
FIG. 7 shows in enlarged scale, a partial cross-section view, taken along line VII—VII in FIG. 8, of the drop lever in the region of a pressure spring for a pin that projects from the drop lever and that can be displaced against the pressure of this spring, and that works with the sliding bar by means of the end that projects from the drop lever.
Figure 8:
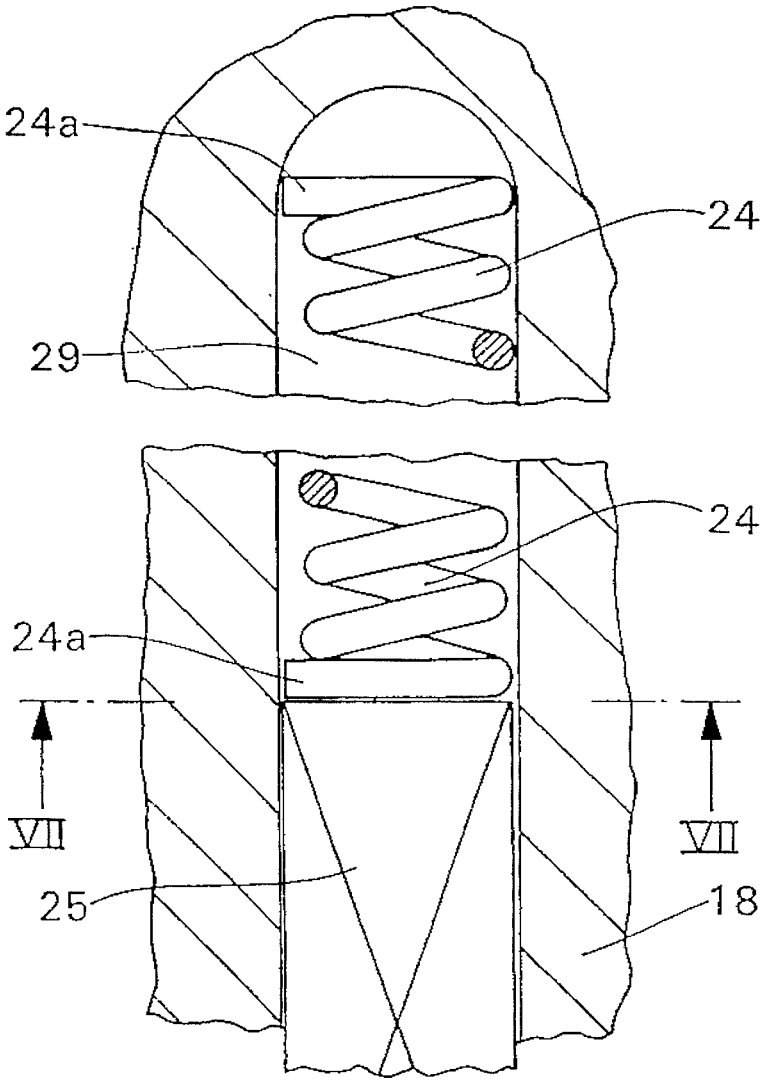
FIG. 8 is a partially broken away longitudinal section view of the opening in FIG. 7 with the pressure spring and the end of the pin that is contacted by it.

In FIGS. 7 and 8 there is illustrated a modification of the pressure spring 24 to the effect that this pressure spring is indeed equipped with helical windings, but is nevertheless safeguarded against turning by virtue of the fact that its ends 24*a* run parallel to a wall 29*a* of the opening 29, which is roughly square in cross-section, all the way to the corner with the adjacently arranged wall 29*b*. Any turning of the pressure spring 24 or of broken pieces of the spring is thus prevented by that alone, and the spring cannot slip laterally, so that the spring retains its effect even in the event of a break.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A numerical combination lock (1) comprising a rotatable turning knob (3), a cam plate (4) having a drop opening (7) therein, and a drop lever (5) that is hinged to a locking bolt (2) and has a hook-like projection (6) such that, with a correct selection of an opening combination of the lock (1), the hook-like projection (6) engages with the drop opening (7) of the cam plate (4), and upon turning of the cam plate (4) pulls the locking bolt (2) to an open position, said turning knob (3) further having means for setting of individual values of the opening combination at different angles of rotation of the knob, said knob also being axially displaceable in order to operate an electric switch (11) assigned to each setting value, whereby individual setting values can be sent electrically by means of switches (11) assigned to them to a memory containing the opening combination, an electric motor (12), controlled by said memory and arranged in a sliding bar (13) which has an original locked position, a coupling member (14) carried on the sliding bar (13) and movable into a region of a first working surface (15) of a first cam of the cam plate (4) upon correct selection of the opening combination, whereby turning of the cam plate (4) operates the sliding bar (13), which acts upon a lever arm (18) of the drop lever (5) and swivels the drop lever into a position for engaging the drop opening (7), positions of the first working surface (15) and the drop opening (7) being matched to each other in such a way that displacement of the sliding bar (13) and swiveling of the drop lever (5) are completed at approximately the same time, the sliding bar (13) having a projection (20) which faces the cam plate (4) such that, when the cam plate (4) is turned back in order to close the locking bolt (2), the projection (20) is contacted by a second working surface (21) of the cam plate (4), whereby the sliding bar (13) is forced to move back to its original position as a result of turning of the cam plate (4) when the lock (1) is being closed.

2. Numerical combination lock according to claim 1, wherein the first working surface (15) and the second working surface (21) are arranged one behind the other on the cam plate (4).

3. Combination lock according to claim 1, further comprising a resetting spring (22) for return of the sliding bar (13), whereby the sliding bar (13) is displaceable against a force of the resetting spring (22) during swiveling of the drop lever (5) into the cam plate (4).

4. Combination lock according to claim 3, wherein the force of the resetting spring (22) is selectable to be of such a magnitude that it at least assists displacement of the sliding bar (13) back to its original position.

5. Combination lock according to claim 1, further comprising a lever arm (18) provided on the drop lever (5) to help it swivel into position for engagement with the drop opening (7), the lever arm (18) having a pin (25) which is displaceable against a pressure spring (24), a projecting end (26) of the pin (25) engaging into a recess (27) in the sliding bar (13) and, at least in an open position of the drop lever (5), the pin (25) runs diagonally against the direction of displacement of the sliding bar (13) during opening, and during displacement of the sliding bar (13), the pin (25) is adjustable in the lever arm (18) against the pressure spring (24) in order to compensate for difference in travel between arcs described by the lever arm (18) and the pin (25) and a contrasting straight movement of the sliding bar (13).

6. Combination lock according to claim 5, wherein the recess (27) is restricted on both sides of the pin (25).

7. Combination lock according to claim 5, further comprising an opening (29) provided in the drop lever (5) to accept the pin (25) and the pressure spring (24), said opening having, at least in some regions, a polygonal cross-section.

8. Combination lock according to claim 7, wherein the opening 29 has a tetragonal cross-section.

9. Combination lock according to claim 8, wherein the opening 29 has a square cross-section.

10. Combination lock according to claim 7, wherein at least one end (24*a*) of the pressure spring (24) runs parallel to a wall (29*a*) of the opening (29) up to a corner with an adjacent wall (29*b*) so that the opening (29) encloses the at least one end (24*a*) of the pressure spring (24) in a manner that provides a form-fit and a safeguard against turning.

11. Combination lock according to claim 5, wherein the pin (25) has a continuation (30) that fits inside of the pressure spring (24) and is shorter than the pressure spring (24) by at least a length of spring travel when compressed.

12. Combination lock according to claim 1, wherein the cam plate (4) has at its circumference in a region adjacent to the drop opening (7) a sliding curve (32), and the locking bolt (2) has a projecting thrust surface (33) to cooperate with the sliding curve (32) when the locking bolt (2) is being pushed into the closed position.

13. Combination lock according to claim 1, wherein the coupling member (14) is a turnable lever that holds the sliding bar (13) in its original position.

* * * * *